US007259680B2

(12) United States Patent
Popp

(10) Patent No.: US 7,259,680 B2
(45) **Date of Patent: *Aug. 21, 2007**

(54) PERSONAL PROPERTY/ANIMAL IDENTIFICATION AND SECURITY SYSTEM

(76) Inventor: Joseph B. Popp, 1133 Lincoln St., Hobart, IN (US) 46342-6039

( * ) Notice: Subject to any disclaimer, the term of this patent is extended or adjusted under 35 U.S.C. 154(b) by 233 days.

This patent is subject to a terminal disclaimer.

(21) Appl. No.: 11/049,497

(22) Filed: Feb. 1, 2005

(65) Prior Publication Data

US 2005/0178826 A1 Aug. 18, 2005

Related U.S. Application Data

(63) Continuation-in-part of application No. 10/777,302, filed on Feb. 12, 2004.

(51) Int. Cl.
*G08B 23/00* (2006.01)

(52) U.S. Cl. ..... 340/573.1; 340/539.1; 340/539.11; 340/539.13; 340/573.3; 235/380; 235/375

(58) Field of Classification Search ..... 340/573.1, 340/539.1, 539.11, 539.13, 573.3, 573.4, 340/691.6; 235/380, 375
See application file for complete search history.

(56) References Cited

U.S. PATENT DOCUMENTS 4,408,215 A * 10/1983 Kitchen ..... 347/166
5,315,505 A * 5/1994 Pratt et al. ..... 600/300
5,355,839 A * 10/1994 Mistry ..... 119/858
5,587,575 A * 12/1996 Leitner et al. ..... 235/384
5,603,094 A * 2/1997 Greear, Jr. ..... 455/66.1
5,803,906 A * 9/1998 Pratt et al. ..... 600/300
5,942,812 A * 8/1999 Charrier et al. ..... 307/116
6,228,241 B1 * 5/2001 Alwitt et al. ..... 205/50
6,259,367 B1 * 7/2001 Klein ..... 340/572.1

* cited by examiner

*Primary Examiner*—Daryl C. Pope
(74) *Attorney, Agent, or Firm*—Wildman Harrold Allen & Dixon

(57) ABSTRACT

A property security system and method therefor assigns a property code uniquely associated with each property owning member. The property marker code includes an abbreviation for the state of residence of the property owner, a first numerical code identifying the county in which the member, or property owner, resides or is located, and a second numerical code identifying the township of the owner's residence or location. The township is divided into one mile square portions, with each one mile square portion further divided into quadrants to identify the owner's residence/location to within a 160 acre area. This coded indicia further includes an individual member number for each owner in the property security system. Another embodiment envisions using the security system for marking and identifying individual animals such as used in business with appropriate owner and animal identification and location indicia for identifying/locating the owner of lost, missing or sick animals.

28 Claims, 5 Drawing Sheets

PERSONAL PROPERTY/ANIMAL IDENTIFICATION AND SECURITY SYSTEM

CROSS REFERENCE TO RELATED APPLICATION AND PATENT

This application is a continuation-in-part of U.S. patent application Ser. No. 10/777,302, filed on Feb. 12, 2004 in the name of the present applicant. This invention relates to U.S. Pat. No. 6,533,172 for "Property Security System and Method Therefore," issued on Mar. 18, 2003 in the name of the present applicant, the disclosure of which is hereby incorporated by reference in the present application.

FIELD OF THE INVENTION

This invention relates generally to identification of and security for personal property and for animals such as used in commercial businesses and is particularly directed to a system and method for assigning and recording an individual owner identifying code for each system member as well as for each personal property item/animal owned by each member. Each property item/animal is permanently marked with this code which also identifies the type of property or animal and the country of origin in the case of an animal. All of the owner property item/animal codes are stored in a computerized system connected to a global information network for worldwide dissemination of this information to facilitate the return of lost/stolen personal property items or animals to their rightful owner and the tracking of individual animals for public health and safety reasons.

BACKGROUND OF THE INVENTION

A need exists for identifying and tracking domesticated animals such as used in commercial businesses such as those involving dairy and beef cattle, sheep, hogs, horses, goats, llamas, birds, etc. Marking personal property such as tools and machines essential to the operation of a business is common. However, there is currently no available system for identifying which animals belong to a particular owner and the location of that owner. This information would be helpful in the recovery of lost or stolen animals to return the missing animals to their rightful owner, as well as for identifying the owner or source of animals having a dangerous disease which may threaten humans or other animals. The need for this type of system as a high priority became clear with the recent "mad cow" disease threat in the beef industry. Information as to the source and history of a diseased animal could be vitally important in locating and identifying the origin of a dangerous and possibly economically devastating animal disease, as well as for limiting exposure of humans and animals which might be potentially affected by the disease. This important information is currently not available to any government or regulatory body for use in preventing or combating a dangerous animal epidemic. In addition, a centralized animal identification and security system would facilitate the return of lost/stolen animals to their rightful owner as well as the transfer of ownership of animals by using a single database which is easily updated and universally accessible to provide realtime animal ownership information.

The present invention also addresses the need for a centralized, universal system for maintaining ownership information for items of personal property by providing a personal property security system, and method therefor, which provides for the centralized recording and storage of ownership information relating to personal property items as well as to the permanent marking of ownership indicia on the item. Furthermore, a universal system is needed which is capable of uniquely identifying and locating the owner of an item of personal property and storing this information in a manner which is easily accessible to anyone regardless of where the person resides or is located.

The present invention addresses the aforementioned limitations of the prior art by providing an animal identification and security system and method which assigns an identifying code uniquely associated with each animal owner member as well as each individual animal owned by the member. This identification and security system and method is particularly adapted for use with commercial animals used in the conduct of a business such as cattle, hogs, sheep, horses, etc. The animal identification and security system provides for the centralized recording and storage of ownership information relating to animals as well as to the permanent marking of ownership indicia on each animal. Ownership indicia includes information relating to the state, county and township of residence or location of the animal owner and the owner's ranch or farm, as well as the particular type of animal, the specific animal in each owner's herd/flock, and the country of origin of each animal. This information is maintained in a computerized system at a central location and is made available on a global information network to disseminate this animal owner information on a worldwide basis to facilitate the return of lost or stolen animals to the rightful owner. Another embodiment of this invention contemplates a personal property security system and method therefor wherein the same type of information is affixed to items of personal property and is also available on a global information network for worldwide dissemination to facilitate the recovery and return of lost or stolen articles of personal property to the rightful owner.

OBJECTS AND SUMMARY OF THE INVENTION

Accordingly, it is an object of the present invention to provide a system and method for marking personal property or animals in a manner which uniquely identifies the owner and the owner's residence or location.

It is another object of the present invention to mark animals or personal property such as used in commercial businesses in a manner which uniquely identifies the animal or personal property item using a marking code which identifies the state, county and township of residence or location of the owner, as well as the owner's ranch or farm within the designated township in the case of animal identification or the owner's membership number in the security system in the case of a personal property item.

Yet another object of the present invention is to provide an animal marking code uniquely identifying the animal's owner as well as the owner's state, county and township of residence or location and the type of animal, which indicia is recorded and stored in a central location and is available on a global information network.

A still further object of the present invention is to provide an international registration and recording system for commercial-type animals and personal property which uniquely identifies the owner and location of the animal or personal property as well as the type of animal or personal property and the country of origin of the animal and makes this information available on a global information network.

Still another object of the present invention is to provide a system and method for marking personal property in a manner which uniquely identifies the property owner and the property owner's residence or location.

Yet another object of the present invention is to provide a personal property marking code uniquely identifying the property owner as well as the property owner's state, county and township of residence or location which is recorded and stored at a central location and is available on a global information network.

It is another object of the present invention to provide a system and method particularly adapted for use in marking luggage for the purpose of identifying and locating the owner in the event the luggage is lost or misplaced.

The present invention contemplates a system and method for identifying an animal and the owner of the animal. The system makes use of first coded indicia comprising a first portion identifying a state of residence or location of the owner; a second portion identifying a county of residence or location of the owner; a third portion identifying a township of residence or location of the owner within the county; and a fourth portion uniquely identifying a farm or ranch on which the owner resides or is located within the owner's county and township. The system further employs second coded indicia uniquely identifying the animal, which comprises a fifth portion identifying the type of animal; a sixth portion identifying the individual animal within the owner's herd or flock by number; and a seventh portion identifying the country of origin of the animal. The invention also includes a marker, or tag, containing the first and second coded indicia permanently attached to the animal; a memory storing the first and second coded indicia in a central location for future reference; and a global information network coupled to the memory for making the first and second coded indicia available on a worldwide basis.

This invention further contemplates a system for identifying the owner of an item of personal property comprising: coded indicia uniquely identifying the owner, the coded indicia comprising: a first portion identifying a state of residence or location of the owner; a second portion identifying a county of residence or location of the owner; a third portion identifying a township of residence or location of the owner within the county; and a fourth portion assigning the owner a unique membership number in the system; a marker for applying the coded indicia to the item of personal property; a memory for storing the coded indicia at a central location for future reference; and a global information network coupled to the memory for making the coded indicia available on a worldwide basis.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

DETAILED DESCRIPTION OF THE PREFERRED EMBODIMENTS

Figure 1:
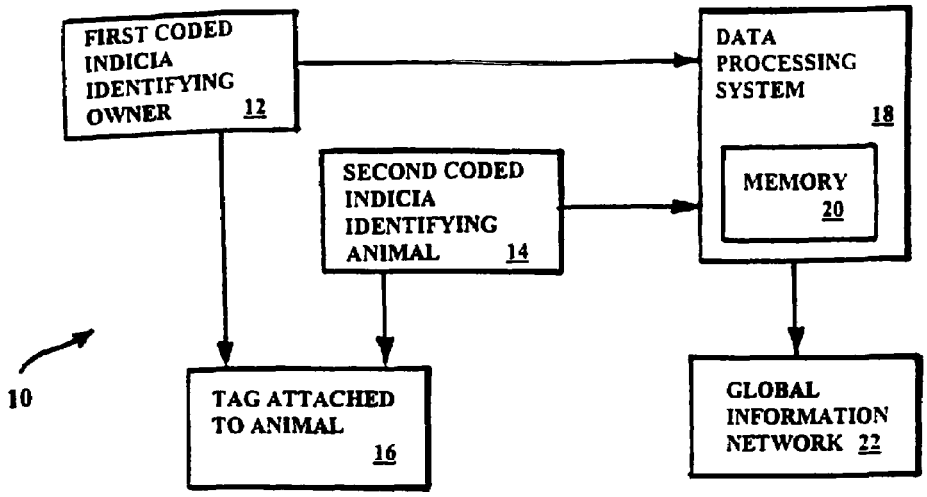
FIG. 1 is a simplified block diagram of an animal identification and security system in accordance with the principles of one embodiment of the present invention.

Referring to FIG. 1, there is shown a simplified block diagram of an animal identification and security system 10 in accordance with the principles of one embodiment of the present invention. The animal identification and security system 10 makes use of first coded indicia 12 identifying the owner of an animal to be registered in the system. The format and content of this first coded indicia 12 is described in detail below. The first coded indicia 12 associated with a respective animal owner is affixed to a tag or marker 16 for permanent attachment to the animal. Marker 16 may take on various forms, with a preferred embodiment for the marker described in detail below. The animal identification and security system 10 also makes use of second coded indicia 14 which uniquely identifies each animal. The second coded indicia 14 is also clearly and permanently affixed to the marker 16 for attachment to the animal.

The first coded indicia 12 and second coded indicia 14 are also input to a data processing system 18. Date processing system 18 includes, among other things, a memory 20 for storing the first and second coded indicia 12, 14 for the animals of each registered animal owner. Data processing system 18 may be conventional in design and operation and is preferably disposed at its central location. Memory 20 in which animal owner identification as well as coded indicia associated with each individual animal is stored is also of conventional design and operation. Memory 20 could typically be in the form of a random access memory (RAM) which allows for the entry and update of animal ownership data stored in the memory. Data processing system 18 is connected to a global information network 22, such as the Internet, to allow for universal accessing of the animal ownership and identification information in the form of the first and second coded indicia 12, 14 stored in the data processing system's memory 20. This permits individuals as well as various organizations, such as regulatory agencies and healthcare organizations, around the world to check the animal owner and animal identification coded indicia stored in the data processing system's memory 20 to determine or verify ownership of a given animal as well as to determine the history of an animal. By storing this information and making it available on a universal basis, animal ownership determination and animal identification can be accomplished faster, more easily and more reliably than heretofore available.

Figure 2:
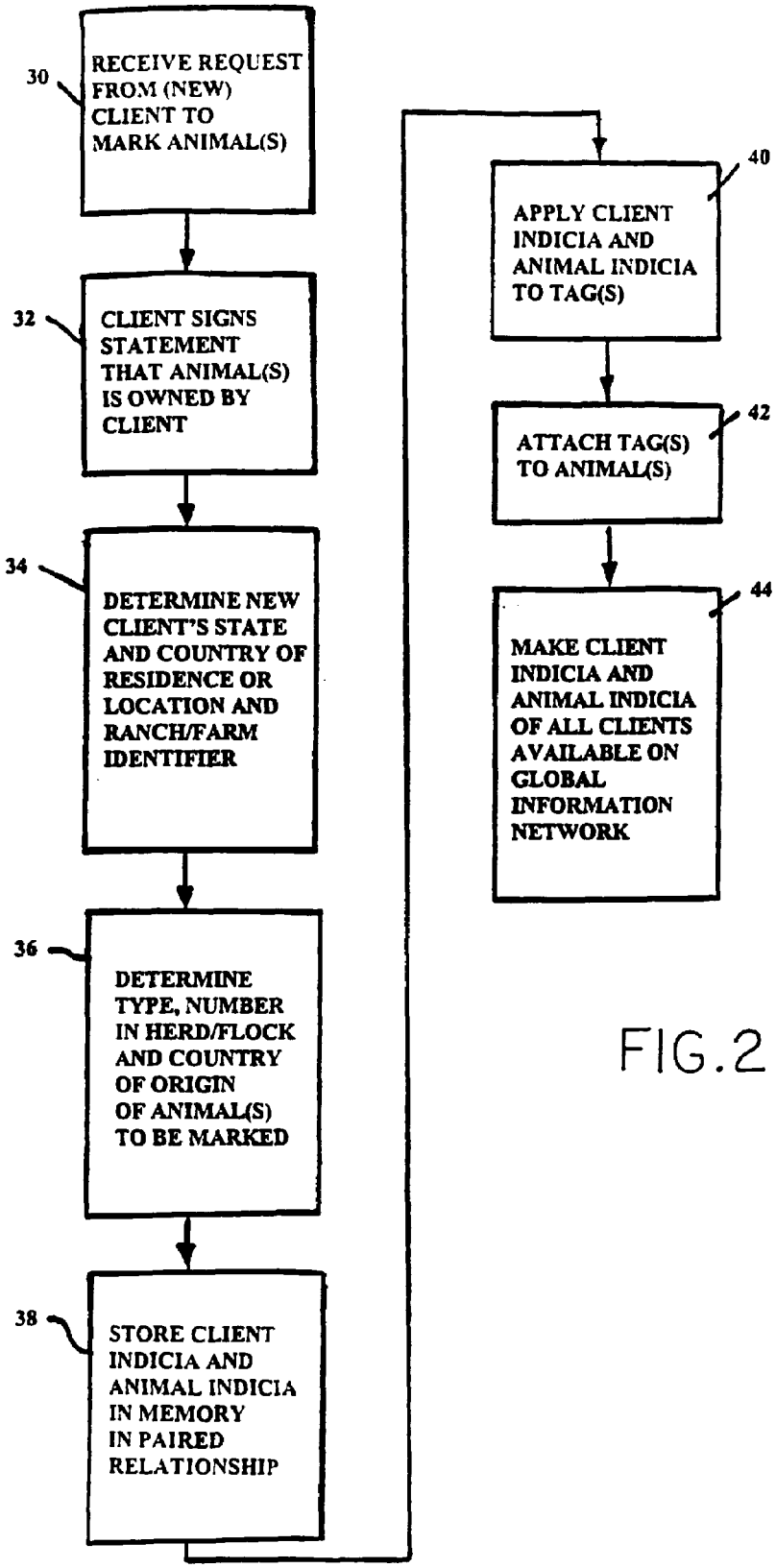
FIG. 2 is a simplified flow chart illustrating the sequence of steps involved in carrying out the animal identification and security system and method shown in FIG. 1.

Referring to FIG. 2, there is shown a simplified flow chart illustrating the series of steps involved in carrying out an animal identification and security system and method in accordance with the principles of the embodiment of the present invention shown in FIG. 1. At step 30, a request is received from a new client, or animal owner, to mark an animal with coded indicia for uniquely identifying the client as the owner of the animal, the residence or location of the animal's owner, the type and identity of the specific animal being marked, and the origin of the animal. The request received in step 30 may also come from an animal owner already registered in the system who would like to register additional animals in the system. The first coded indicia 12 is comprised of a combination of alphanumeric characters identifying the state and county of residence or location of the owner. For example, the first two characters of the first coded indicia 12 are comprised of a two letter abbreviation of the state in which the owner resides or is located. More specifically, the first two characters of the first coded indicia 12 for an Indiana resident are "IN", while the first two characters for an Illinois resident are "IL". The next two characters in the first coded indicia 12 are in the form of a number representing the county of residence or location of the owner within a given state. All states make use of a numerical system for designating each county within that state. An example of a numerical listing employed by the state of Indiana for counties in that state is shown in Table I. For example, the first four characters in the first coded indicia 12 for a resident of Porter county in Indiana would be "IN64". Finally, a last set of characters in the first coded indicia 12 identifies the ranch or farm of the owner within the designated state and county. A "slash" separates the county designation number and the ranch or farm designation number. As each new owner is registered, a number is assigned to that owner's ranch or farm. Thus, a complete first coded indicia for a new owner residing in Porter county, Indiana might be represented as "IN64/201", where the number 201 indicates that the client resides or is located on ranch or farm number 201 within Porter county, Indiana.

This embodiment of the invention further contemplates including in this first coded indicia the animal owner's township as well as the specific location within the owner's township of his/her residence or location as described in detail below.

TABLE I

| |
|---|
| 1. Adams |
| 2. Allen |
| 3. Bartholomew |
| 4. Benton |
| 5. Blackford |
| 6. Boone |
| 7. Brown |
| 8. Carroll |
| 9. Cass |
| 10. Clark |
| 11. Clay |
| 12. Clinton |
| 13. Crawford |
| 14. Daviess |
| 15. Dearborn |

TABLE I-continued

| |
|---|
| 16. Decatur |
| 17. Dekalb |
| 18. Delaware |
| 19. Dubois |
| 20. Elkhart |
| 21. Fayette |
| 22. Floyd |
| 23. Fountain |
| 24. Franklin |
| 25. Fulton |
| 26. Gibson |
| 27. Grant |
| 28. Greene |
| 29. Hamilton |
| 30. Hancock |
| 31. Harrison |
| 32. Hendricks |
| 33. Henry |
| 34. Howard |
| 35. Huntington |
| 36. Jackson |
| 37. Jasper |
| 38. Jay |
| 39. Jefferson |
| 40. Jennings |
| 41. Johnson |
| 42. Knox |
| 43. Kosciusko |
| 44. LaGrange |
| 45. Lake |
| 46. Laporte |
| 47. Lawrence |
| 48. Madison |
| 49. Marion |
| 50. Marshall |
| 51. Martin |
| 52. Miami |
| 53. Monroe |
| 54. Montgomery |
| 55. Morgan |
| 56. Newton |
| 57. Noble |
| 58. Ohio |
| 59. Orange |
| 60. Owen |
| 61. Parke |
| 62. Perry |
| 63. Pike |
| 64. Porter |
| 65. Posey |
| 66. Pulaski |
| 67. Putnam |
| 68. Randolph |
| 69. Ripley |
| 70. Rush |
| 71. St. Joseph |
| 72. Scott |
| 73. Shelby |
| 74. Spencer |
| 75. Starke |
| 76. Steuben |
| 77. Sullivan |
| 78. Switzerland |
| 79. Tippecanoe |
| 80. Tipton |
| 81. Union |
| 82. Vanderburgh |
| 83. Vermillion |
| 84. Vigo |
| 85. Wabash |
| 86. Warren |
| 87. Warrick |
| 88. Washington |
| 89. Wayne |
| 90. Wells |
| 91. White |
| 92. Whitely |

The second coded indicia 14 is also comprised of a combination of alphanumeric characters, with these latter alphanumeric characters identifying the type, or species, of the animal, the specific number of the animal within the owner's herd or flock, and the country of origin of the animal. Thus, the second coded indicia 14 may take the form of "BD175CA", where "BD" designates a bovine dairy animal, or cow, "175" designates the 175th animal in the owner's herd or flock, and "CA" designates Canada as the country of origin of the animal. Table II is a partial alphabetic listing of letters representing various types of animals contemplated for use in the animal identification and security system of the present invention. Similarly, Table III is a partial listing of country codes which could be used for identifying the country of origin of the animal. While the present invention is disclosed primarily for use with animals used in commercial businesses such as in agriculture, the inventive animal identification and security system may be used in identifying and tracking virtually any type of animal owned by man.

TABLE II

| LETTER DESIGNATION | ANIMAL |
|---|---|
| A | Alpacas |
| BB | Bovine Beef (Cattle) |
| BD | Bovine Dairy (Cows) |
| C | |
| D | Donkeys |
| E | Equine |
| F | |
| G | Geese |
| H | Hogs |
| I | |
| J | |
| K | |
| L | Llamas |
| M | |
| N | |
| O | Ostriches |
| P | Poultry |
| Q | |
| R | Rabbits |
| S | Sheep |
| T | Turkeys |
| U | |
| V | Vicunas |
| W | |
| X | |
| Y | Yaks |
| Z | Zebras |

TABLE III

| COUNTRY | ABBREVIATION |
|---|---|
| Australia | AU |
| Austria | AT |
| Belgium | BE |
| Brazil | BR |
| Canada | CA |
| China | CN |
| Colombia | CO |
| Costa Rica | CR |
| Czech Republic | CZ |
| Denmark | DK |
| Finland | FI |
| France | FR |
| Germany | DE |
| Granada | GD |
| Greece | GR |
| Hungary | HU |

TABLE III-continued

| COUNTRY | ABBREVIATION |
|---|---|
| Indonesia | ID |
| Ireland | IE |
| Israel | IL |
| Japan | JP |
| Korea, Republic of | KR |
| Mexico | MX |
| Netherlands | NL |
| New Zealand | NZ |
| Russian Federation | RU |
| South Africa | ZA |
| Spain | ES |
| Sweden | SE |
| Switzerland | CH |
| Turkey | TR |
| Ukraine | UA |
| United Kingdom | GB |
| United States | US |

After a request is received from a new or existing client at step 30, the next step 32 involves a client signing a statement to the effect that the animal, or animals, to be registered and marked is the property of the client. This statement would preferably be in the form of an affidavit made under oath before a notary public or other person of authority. The next step 34 in the inventive process is to determine the client's state, county and township of residence or location and the client's ranch/farm identifying number. The client's state, county and township of residence or location is assigned an alphanumeric code as described above, while the client's ranch/farm may be assigned a numerical identifier in accordance with the order in which the client registers in the animal identification and security system. After the client's state, county and township of residence or location is determined as well as the client's ranch/farm identifier at step 34 the type, number in the owner's herd/flock, and country of origin of the animal to be marked is determined at step 36. The client indicia (first coded indicia) and the animal indicia (second coded indicia) are then stored in memory in a paired relationship for uniquely identifying the owner as well as the animal being marked at step 38. At step 40, the client indicia and animal indicia are permanently applied to the marker to be attached to the animal. The marker is then attached to the animal at step 42 as described below and the client indicia and animal indicia assigned to that specific animal are made available on a global information network for worldwide dissemination at step 44.

Figure 3:
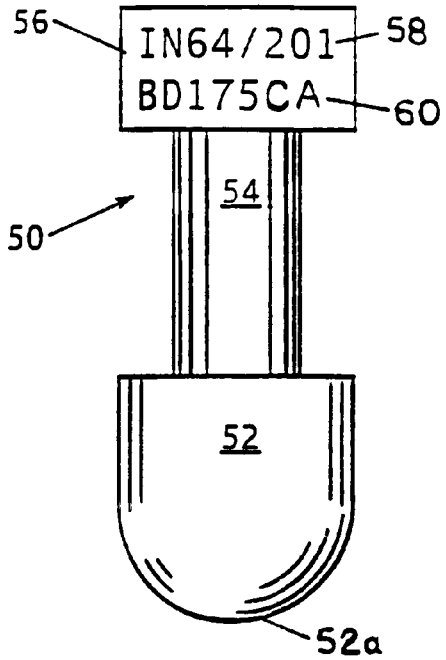
FIG. 3 is a side elevation view of a marker, or tag, containing indicia uniquely identifying an animal and the animal's owner which is adapted for permanent attachment to or implantation in an animal in accordance with one embodiment of the present invention.
Figure 4:
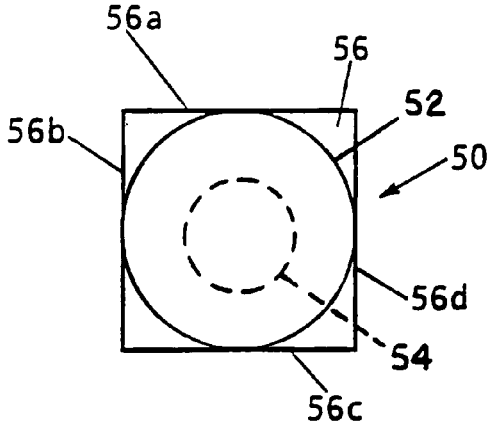
FIG. 4 is an end-on view of the animal marker shown in FIG. 3.
Figure 5:
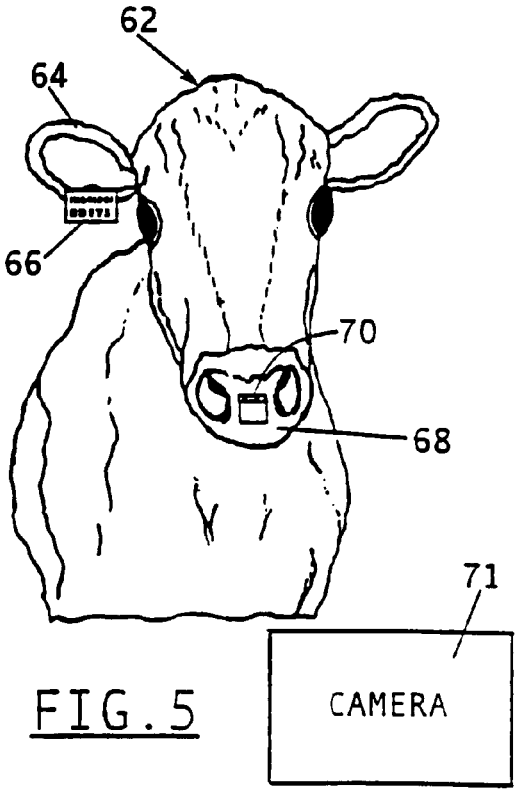
FIG. 5 illustrates two different markers containing animal and animal owner indicia attached to a cow in accordance with different embodiments of the present invention.

Referring to FIG. 3, there is shown a side elevation view of one embodiment of a marker, or tag, 50 for use in the animal identification and security system of the present invention. An end-on view of the marker 50 is shown in FIG. 4. Marker 50 is preferably comprised of a high strength, lightweight material such as plastic and is on the order of ⅝" long and ¼" wide at its maximum width. Marker 50 is preferably white and unitary in structure and includes a semi-spherical end member 52 having a semi-spherical distal end 52*a*, a rectangular member 56 disposed on a second, opposed end, and a cylindrical shaft 54 connecting the cylindrical end and the rectangular end. In a preferred embodiment, the semi-spherical end member 52 is ¼" in length and ¼" in diameter; the cylindrical shaft 54 is ⅛" in diameter and ¼" long; and the rectangular member 56 is ¼" on each lateral side and ⅛" thick. Disposed on each of the four (4) lateral faces of the rectangular member 52 is a first indicia line 58 and a second indicia line 60. As previously described, the first indicia line contains information uniquely identifying the animal's owner, while the second indicia line 60 contains information uniquely identifying the animal to which the marker 50 is attached. The first and second indicia lines 58 and 60 are permanently placed on the marker 50 by conventional means, such as by molding into the rectangular member 52, but may be changed if ownership of the animal changes. This indicia could be changed by imprinting or affixing new indicia on the marker 50 by any of various well known processes or techniques. A camera 71 is shown in FIG. 5 for photographing the indicia on a marker attached to each animal while the animals are eating or drinking water for making a permanent record of the owner's animals. Over time, the cartilaginous material in the cow's muzzle 68 will overgrow and cover the marker's semi-spherical end member 52 and will be in tight fitting engagement with the marker's cylindrical shaft 54 for permanent attachment of the marker 50 to the animal. In the described and illustrated embodiment, reference to the owner's township of residence or location, and specific location within the township, is omitted for simplicity.

Referring to FIG. 5, there is shown the manner in which a marker 70 in accordance with the present invention is permanently attached to an animal such as a cow 62. The marker 70 shown in FIG. 4 is of the same configuration and size as the marker shown in FIG. 3 and described in detail above. The semi-spherical end of marker 70 is inserted in the muzzle, or snout, 68 of the cow 62 intermediate its nostrils as shown in FIG. 4. Marker 70 is preferably attached to the cow when the cow is a young calf, which allows the cartilaginous material of the cow's muzzle to grow around the spherical end and cylindrical shaft portions of the marker 70 to permanently embed the marker in the cow. The size of the marker's rectangular end is such as to allow the owner and animal indicia disposed thereon to be easily read, with the marker not interfering with the eating, drinking or breathing of the cow. This location of the marker 70 on the cow's muzzle facilitates reading of the indicia on the marker's flat plate end when the cow is eating or drinking water. Marker 70 is inserted in an opening made in the cow's muzzle 68 by a sharp cutting instrument perhaps after administering a local anesthetic to the animal. The cutting instrument may preferably form an "X" shaped incision in the muzzle to facilitate insertion of semi-spherical end member 52 of the marker.

Also shown in FIG. 5 is another embodiment of a marker 66 for permanently affixing animal and animal owner information to an animal in accordance with the present invention. Marker 66 is also comprised of a high strength, rigid or semi-rigid material such as plastic and is permanently affixed to the cow's right ear 64 by conventional means such as staples or wire (not shown for simplicity). The location of marker 66 on cow 62 also facilitates reading of the animal and animal owner indicia on the marker when the cow is eating or drinking water.

Figure 6:
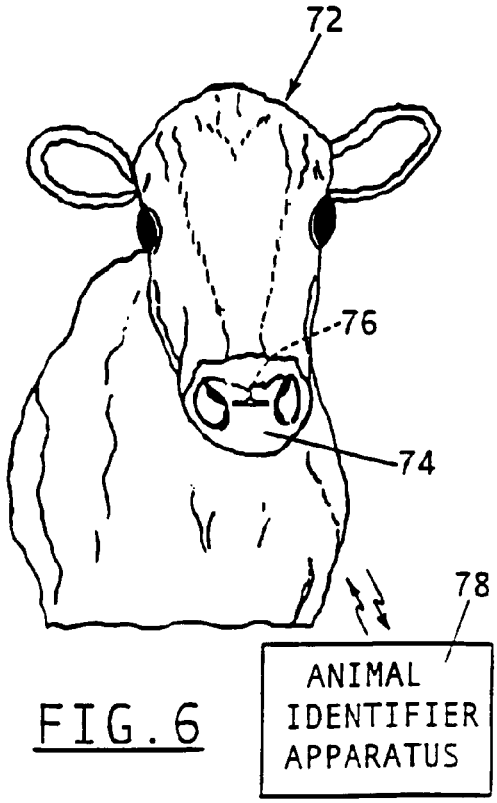
FIG. 6 illustrates another embodiment of a marker containing animal and animal owner indicia implanted in a cow in accordance with the present invention.

Referring to FIG. 6, there is shown another embodiment of a marker 76 (shown in dotted line form) for use with a cow 72. Marker 76 is implanted in the cow's muzzle 74 by means of an incision in the muzzle, which may be closed by conventional means such as stitches or staples. Marker 76 is thus permanently installed in the cow 72. Marker 76 preferably includes an integrated circuit (IC) chip which is responsive to an RF inquiry signal from an animal identifier apparatus 78 which includes a transmitter for directing an RF inquiry signal to the marker 76 and a receiver for receiving a response emitted by the marker. The response provided to the animal identifier apparatus 78 includes the aforementioned animal and animal owner identifier information. By merely scanning the marker 76 with the animal identifier apparatus 78, the animal and the animal owner may be uniquely identified. The animal identifier apparatus 78 may be handheld, or may be mounted to a structure disposed adjacent to where the animals are located or adjacent to a path along which the animals travel. The IC chip marker 76 is preferably re-programmable after being implanted in an animal to accommodate for changes in animal ownership and identification of a new owner.

Figure 7:
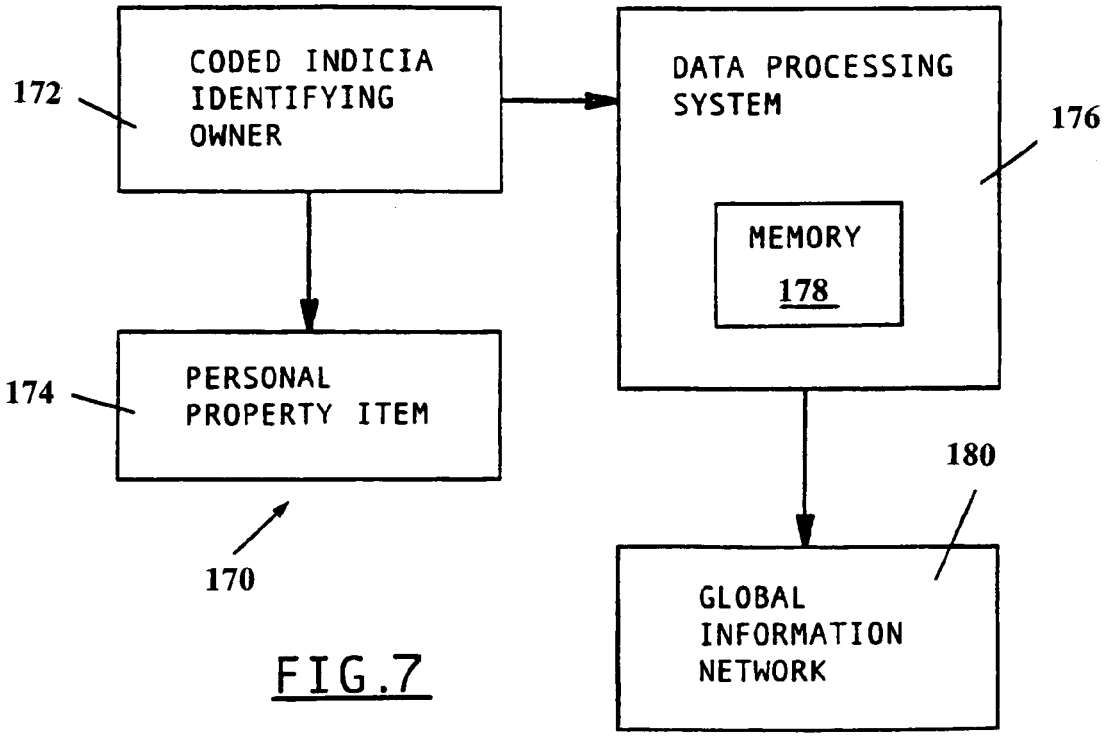
FIG. 7 is a simplified block diagram of a property security system in accordance with the principles of another embodiment of the present invention.

Referring to FIG. 7, there is shown a simplified block diagram of a property security system 170 in accordance with the principles of another embodiment of the present invention. The property security system 170 makes use of coded indicia 172 identifying the owner of an item of personal property. This coded indicia in the subsequent discussion is also referred to as a "membership number" or "parts registration number", as these terms are used interchangeably below. The format and content of this coded indicia 172 is described in detail below. The coded indicia 172 associated with a respective personal property owner is affixed to a personal property item 174 in a manner which is also described in detail below. The coded indicia 172 for the items of personal property associated with each personal property owner is provided, or input to, a data processing system 176. The data processing system 176 includes, among other things, a memory 178 for storing the coded indicia 172 for the items of personal property of each personal property owner. There are many methods which could be used for affixing the coded indicia 172 to a personal property item 174, with a preferred embodiment of the present invention employing electrochemical marking as described in detail below. Data processing system 176 may be conventional in design and operation and is preferably disposed at a central location. Memory 178 in which personal property owner identification as well as the coded indicia associated with each individual personal property owner is stored is also of conventional design and operation. Memory 178 would typically be in the form of a random access memory (RAM) which allows for the entry and update of ownership data stored in the memory. Data processing system 176 is connected to a global information network 180, such as the Internet, to allow for universal accessing of the property owner information and coded indicia stored in the data processing system's memory 178. This permits individuals as well as various organizations such as law enforcement agencies around the world, to check the property owner information and coded indicia stored in the data processing system's memory 178 to determine or verify ownership of a given item of personal property. By centrally storing this information and making it available on a universal basis, property ownership determinations can be accomplished faster, more easily and more reliably than heretofore available.

Figure 8:
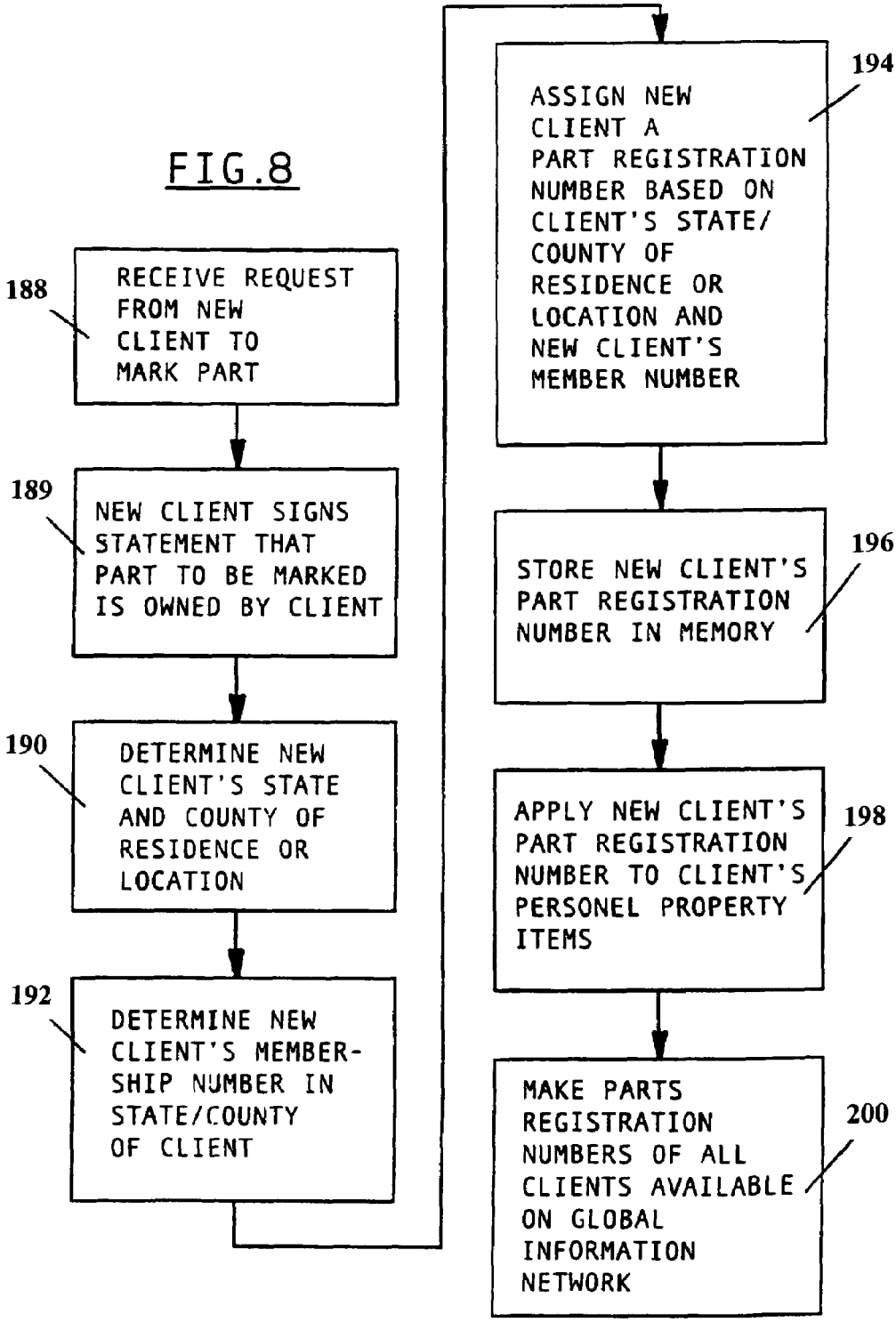
FIG. 8 is a simplified flow chart illustrating the sequence of steps involved in carrying out the property security system and method of the embodiment of the present invention shown in FIG. 7.

Referring to FIG. 8, there is shown a simplified flow chart illustrating the series of steps involved in carrying out a personal property identification and security system and method in accordance with the embodiment of the present invention shown in FIG. 7. The process is initiated at step 188 with the receipt of a request from a new client, or member, to mark an item for personal property, such as a part, with coded indicia uniquely identifying the client. The coded indicia is comprised of a combination of alphanumeric characters identifying the state, county, and township of residence or location of the client, as well as the order in which the client enters, or becomes a member of, the property security system relative to other clients residing in the same state and county. For example, the first two characters of the coded indicia are comprised of a two letter abbreviation of the state in which the new client resides or is located. The next two characters in the coded indicia are in the form of a number representing the county of residence or location of the new client in a given state. The next set of alphanumeric characters identifies the new client's township within the indicated county as well as the client's location within his/her township. Finally, a last set of characters in the coded indicia identifies the new client in terms of the order in which the new client became a registered member of the property security system, i.e., had his or her coded indicia stored in the data processing system's memory 178. Thus, coded indicia for a new client residing in Porter county, Jackson township (T6), Indiana might be represented as "IN64T6/5NW465", where the number 465 indicates that the client is the four hundred and sixty fifth client among clients residing or located in Porter county, Indiana to become a member of the property security system. The portion "5NW" designates the client's location of residence or simply the client's location in Jackson township as described in detail below.

After a request is received from a prospective new client to mark a part at step 188, the next step 189 involves the new client signing a statement to the effect that the part to be marked is the property of the client. This statement would also preferably include the new client's individual assigned registration number determined as described in detail below and would preferably be made under oath in the form of an affidavit before a notary public or other person of authority. The next step in the inventive process is to determine the new client's state and county of residence or location at step 190. After the new client's state and county of residence or location is determined, the next step is to determine the new client's membership number in the new client's state and county at step 192. For example, if the client is the $465^{th}$ member of the property security system, of those members residing or located in Porter county, Indiana, the new client would be assigned the number "465" as a portion of his or her coded indicia. A part registration number based on the client's state, county, and township of residence or location as well as the client's membership number is then assigned to the new client at step 194. The new client's membership number is then stored in the data processing system's memory at step 196 and the membership numbers of all clients are then made available on a global information network at step 198. Finally, at step 200 the new client's membership number is applied or affixed to the client's personal property items. This facilitates the identification of the owner of items of personal property on a universal basis and provides access to such information to various organizations, including law enforcement agencies.

In accordance with both embodiments of the present invention described above, this personal property/animal identification and security system further contemplates the inclusion of the personal property/animal owner's township of residence or location within the county of the owner. A township is a subdivision of a county in most states having the status of a unit of local government with varying governmental powers. Each township typically is thirty-six (36) square miles in area and can be divided into thirty-six (36) individual sections. Each of the individual sections is one (1) square mile in area. This is shown in Table IV which includes thirty-six (36) one (1) square mile township subunits within the thirty-six (36) square mile township, with the township being six (6) miles in length in each of its four sides and each of the subunits being one (1) mile in length on each of its four sides. The thirty-six (36) township subunits would preferably be arranged in a 6×6 matrix array and designated by numbers of from 1 to 36, where the subunit designation numbers increase in magnitude in

TABLE V

| IN | 64 | T6 | NW | 5 | R465 |
|---|---|---|---|---|---|
| I | P | J | N | S | I |
| N | O | A | O | Q | N |
| D | R | C | R | U | D |
| I | T | K | T | A | I |
| A | E | S | H | R | V |
| N | R | O | W | E | I |
| A | C | N | E | N | D |
| | O | T | S | U | U |
| | U | O | T | M | A |
| | N | W | Q | B | L |
| | T | N | U | E | C |
| | Y | S | A | R | L |
| | | H | D | 5 | I |
| | | I | R | | E |
| | | P | A | | N |
| | | | N | | T |
| | | | T | | # |

TABLE IV

| | | | | | |
|---|---|---|---|---|---|
| 1 | 2 | 3 | 4 | 5 | 6 |
| 7 | 8 | 9 | 10 | 11 | 12 |
| 13 | 14 | 15 | 16 | 17 | 18 |
| 19 | 20 | 21 | 22 | 23 | 24 |
| 25 | 26 | 27 | 28 | 29 | 30 |
| 31 | 32 | 33 | 34 | 35 | 36 |

proceeding from left to right across six (6) vertically aligned columns and from top to bottom in proceeding across six (6) horizontally aligned rows.

This aspect of the present invention thus contemplates marking an item of personal property or an animal with the state, county, township and location within the township of the owner's residence or location. In order to more precisely identify the personal property/animal owner and to facilitate locating the owner, this embodiment of the invention further contemplates specifying a one (1) mile square within the owner's township as well as the quadrant of the one (1) square mile township subunit within which the owner resides or is located. This owner identification and location arrangement for marking an item of personal property or an animal is shown in expanded form for explanatory purposes in Table V. Referring to Table V, there is shown the state of the owner's residence or location as Indiana, abbreviated "IN". This is followed by the numerical designation of the owner's county of residence or location, which in the example shown is for Porter county designated as county number "64" as shown in Table V. In most states the counties are arranged in alphabetical order and are assigned a numerical identifier based upon alphabetical order. Next is designated the owner's township within Porter county as "T6". The "T" indicates a township designation, while the number "6" is used to designate the specific township of Jackson within Porter county. As in the case of counties within a state, each township is given a specific numerical designation within each county, where in the present example the township of Jackson is designated by "T" in combination with the number "6". Townships are generally arranged in alphabetical order within a county and are assigned a numerical identifier based upon alphabetical order. Next is designated a quadrant in one of plural squares within the township of Jackson. Next appears the owner's square number within his/her township. In the present example, the square designated within Jackson township is square number "5" which is shown as cross hatched in Table IV. Each township square is one (1) square mile in area. Each square township subunit is divided into four quadrants, i.e., northwest (NW), northeast (NE), southeast (SE) and southwest (SW), with each quadrant being 160 acres in area. In the example shown, the personal property/animal owner resides or is located in the northwest (NW) quadrant of square 5 in Jackson township (T6) within Porter county (64) in the state of Indiana (IN).

The last piece of information for indicating the individual personal property/animal owner or client within the security system is the owner/client's ranch, farm or residence number preceded by the letter "R". In this example, this is represented in Table V by "R465". This number could represent the client's specific ranch, farm or residence based upon its location within the listed township quadrant. In this example, the owner's identifying indicia would be as follows: IN64T6NW5R465. This level of detail in specifying the individual personal property/animal owner, or security system client, permits the owner/client's location to be specified to within an area of 160 acres of the owner/client's residence or location. The owner/client is even more specifically identified by assigning an individual membership number based upon the member's ranch, farm or residence location or the order in which the member became registered in the personal property/animal identification and security system of the present invention.

This embodiment of the invention is particularly adapted for use in identifying and locating the owner of luggage lost while traveling such as by air. The luggage turned in by each traveling passenger would have been previously marked with the above described indicia which would also be stored in a memory operated by the airlines or associated with a global information network to permit determining the residence or location of the passenger to within a 160 acre area within the United States. Each passenger is specifically identified by assigning an individual membership number as part of this indicia which would be attached to the passenger's luggage. Each airline would either have its own luggage identification and security system or would have access to a single national system which could possibly be managed by a government agency and could be used not only for travel purposes, but to identify and locate the owner of virtually any form of personal (non-real) property, including animals, for owner identification and location purposes.

Applying the owner coded indicia for a personal property system and method just described to the animal identification and security system discussed above would provide an equally reliable, accurate and inexpensive system for identifying and locating the owner of an animal, such as used in business, which is particularly adapted for worldwide application. More specifically, the coded owner/animal indicia used in the animal identification and security system could, as an example, take the form of IN64T6NW5R465BB35MX, where IN—Indiana (state)

64—Porter county

T6—Jackson township

NW—northwest quadrant of fifth one (1) square mile portion of Jackson township

5—fifth one (1) square mile portion of Jackson township

R465—ranch, farm or residence number (or owner's individual identification number)

BB—bovine beef (cattle)

35—animal number 35 in the cattle herd on ranch/farm number R465

MX —Mexico as the country of origin of the animal.

Figure 9:
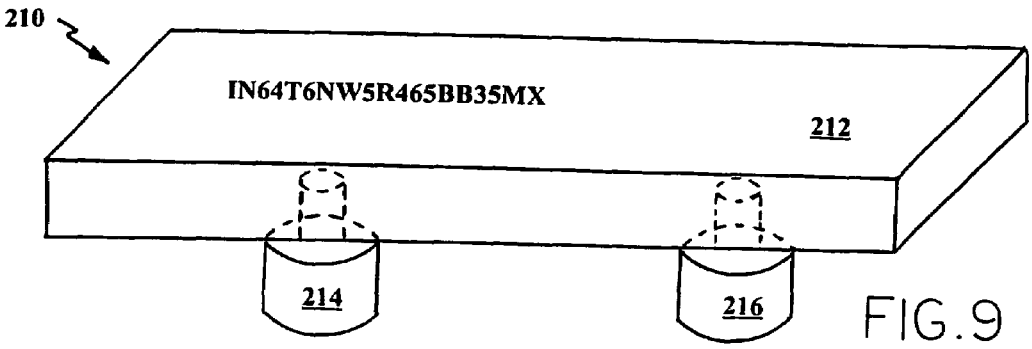
FIGS. 9 and 10 are respectively perspective and side elevation views of another embodiment of a marker, or tag, containing indicia uniquely identifying an animal and the animal's owner which is adapted for permanent attachment to or implantation in an animal in accordance with the present invention.
Figure 10:
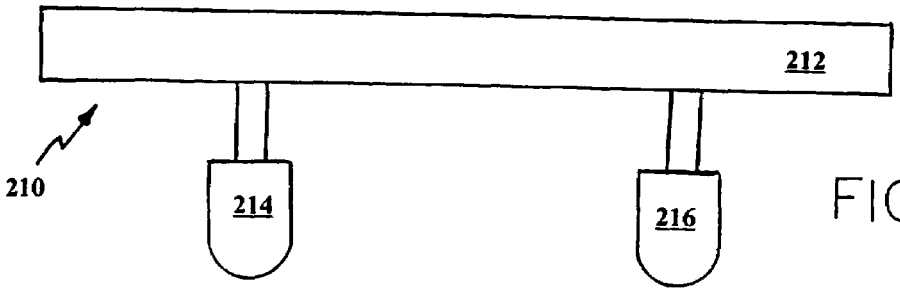

Referring to FIGS. 9 and 10, there are respectively shown perspective and side elevation views of a marker, or tag, 210 in accordance with the present invention which is adapted for permanent attachment to an animal such as a cow or steer in the manner illustrated in FIGS. 5 and 6 and described in detail above. Marker 210 includes a generally flat, or planar, member 212 from which first and second attachment members 214 and 216 extend. One side of the marker's flat member 212 is provided with the indicia identifying the animal to which it is attached as well as the animal's owner as previously described. A second, opposed side of the flat member 212 is provided with the first and second attachment members 214, 216 which extend outwardly therefrom. Each of the first and second attachment members 214, 216 has the general shape of the inner portion of the marker 50 described above and illustrated in FIGS. 3 and 4. Thus, each of the first and second attachment members 214, 216 of marker 210 is adapted for insertion in the cartilaginous material of the muzzle of a cow or steer for permanent attachment thereto. The spaced first and second attachment members, 214, 216 inserted in the animal's muzzle prevents the marker 210 from being displaced by rotating in place. By fixedly attaching the marker 210 to the animal's muzzle, the indicia on the marker is maintained in an upright orientation for ease of reading the animal and animal owner indicia on the marker. As in the previously described embodiment, marker 210 is preferably comprised of a high strength, inert plastic.

While particular embodiments of the present invention have been shown and described, it will be obvious to those skilled in the relevant arts that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. A system for identifying an animal and the owner of the animal comprising:

first coded indicia uniquely identifying the owner, said first coded indicia comprising:

a first portion identifying a state of residence or location of the owner;

a second portion identifying a county of residence or location of the owner;

a third portion identifying a township of residence or location of the owner within said county; and a fourth portion individually identifying the owner as a member of said system;

second coded indicia uniquely identifying the animal, said second coded indicia comprising:

a fifth portion identifying the type of animal;

a sixth portion identifying an individual animal within the owner's herd or flock by number; and a seventh portion identifying the country of origin of the animal;

a marker containing said first and second coded indicia permanently attached to the animal;

a memory storing said first and second coded indicia in a central location for future reference; and a global information network coupled to said memory for making said first and second coded indicia available on a worldwide basis.

2. The system of claim 1 wherein the first portion of said first coded indicia is an abbreviation of the state of residence or location of the owner.

3. The system of claim 2 wherein the second portion of said first coded indicia is a first number identifying the county of residence or location of the owner.

4. The system of claim 2 wherein the fourth portion of said first coded indicia is a second number uniquely identifying a farm or ranch on which the owner resides or is located within the owner's county.

5. The system of claim 1 wherein the fifth portion of said second coded indicia is at least one alphabet character uniquely identifying the type of animal.

6. The system of claim 5 wherein the sixth portion of said second coded indicia is a third number uniquely identifying the animal within the owner's herd or flock.

7. The system of claim 6 wherein the seventh portion of said second coded indicia is a two letter alphabet code identifying the country of origin of the animal.

8. The system of claim 1 wherein the third portion of said first coded indicia includes a fourth number identifying the township of residence or location of the owner within the owner's county.

9. The system of claim 8 wherein the third portion of said first coded indicia further includes a letter "T" in combination with said fourth number for designating the township of residence or location of the owner.

10. The system of claim 9 wherein the third portion of said first coded indicia further includes a first designation of a first geographic portion of the township of residence or location of the owner.

11. The system of claim 10 wherein said first geographic portion is a square-shaped portion of the township of residence or location of the owner.

12. The system of claim 11 wherein the township of residence or location of the owner is comprised of n square-shaped portions, where n=36.

13. The system of claim 12 wherein each square-shaped portion of the township is one (1) square mile in area.

14. The system of claim 13 wherein the third portion of said first coded indicia further includes a second designation of a second geographic portion within said first geographic portion of the township of residence or location of the owner.

15. The system of claim 14 wherein the second geographic portion is a quadrant of a square-shaped portion of the township of residence or location of the owner.

16. The system of claim 15 wherein said quadrant is a northeast, southeast, southwest or northwest quadrant of a square-shaped portion of the township of residence or location of the owner.

17. A method for recording ownership and identification information of animals and distributing said ownership and identification information to facilitate recovery of lost or stolen animals by the owner and identification of the animals, said method comprising the steps of:

assigning first coded indicia to an animal owner by providing a first portion of said first coded indicia in accordance with a state of residence or location of the owner, a second portion of said first coded indica in accordance with a county of residence or location of the owner, and a third portion of said first coded indica in accordance with a township of residence or location of the owner;

assigning second coded indicia to an animal of the owner by providing a fourth portion of said second coded indicia identifying the type of animal, a fifth portion of said second coded indicia identifying the individual animal within the owner's herd or flock, and a sixth portion of said second coded indica identifying the country of origin of the animal;

affixing said first and second coded indicia to the animal;

storing plural paired first and second coded indicia for plural animals in a memory at a central location, wherein each of said paired first and second coded indicia uniquely identifies each of said animal owners and each of said animals; and providing said plural paired first and second coded indicia on a global information network for making said plural paired first and second coded indicia available on a worldwide basis.

18. A system for identifying an owner of an item of personal property comprising:

coded indicia uniquely identifying the owner, said coded indicia comprising:

a first portion identifying a state of residence or location of the owner;

a second portion identifying a county of residence or location of the owner;

a third portion identifying a township of residence or location of the owner within said county; and a fourth portion assigning the owner a unique membership number in the system, wherein the fourth portion of said coded indicia is a first number representing a sequential order associated with when the owner became a member of said system for identifying an owner of an item of personal property;

a marker for applying said coded indicia to the item of personal property;

a memory for storing said coded indicia at a central location for future reference; and a global information network coupled to said memory means for making said coded indicia available on a worldwide basis.

19. The system of claim 18 wherein the third portion of said coded indicia includes a second number identifying the township of residence or location of the owner.

20. The system of claim 19 wherein the third portion of said coded indicia further includes a letter "T" in combination with said second number for designating the township of residence or location of the owner.

21. The system of claim 20 wherein the third portion of said coded indicia further includes a first designation of a first geographic portion of the township of residence or location of the owner.

22. The system of claim 21 wherein said first geographic portion is a square-shaped portion of the township of residence or location of the owner.

23. The system of claim 22 wherein the township of residence or location of the owner is comprised of n square-shaped portions, where n=36.

24. The system of claim 23 wherein each square-shaped portion of a quadrant of the township is one (1) square mile in area.

25. The system of claim 24 wherein the third portion of said first coded indicia further includes a second designation of a second geographic portion within said first geographic portion of the township of residence or location of the owner.

26. The system of claim 25 wherein said second geographic portion is a quadrant of a square-shaped portion of the township of residence or location of the owner.

27. The system of claim 26 wherein said quadrant is a northeast, southeast, southwest or northwest quadrant of a square-shaped portion of the township of residence or location of the owner.

28. A method for recording ownership information of personal property items and distributing said ownership information to facilitate recovery of lost or stolen personal property items by the owner, said method comprising the steps of:

assigning coded indicia to a personal property owner by providing a first portion of said coded indicia in accordance with a state of residence or location of the owner, a second portion of said coded indicia in accordance with a county of residence or location of the owner, a third portion of said coded indicia in accordance with a township of residence or location of the owner, and a fourth portion of said coded indicia in accordance with the sequential order in which the owner's coded indicia is assigned relative to other personal property owners;

affixing said coded indicia to personal property items of the owner;

storing plural coded indicia for plural personal property owners in a memory at a central location, wherein each coded indicia uniquely identifies each of said personal property owners; and providing said plural coded indicia on a global information network for making said plural coded indicia available on a worldwide basis.

* * * * *